US009441468B1

(12) United States Patent
Pryor

(10) Patent No.: US 9,441,468 B1
(45) Date of Patent: Sep. 13, 2016

(54) JET PUMP SYSTEM FOR WELL

(71) Applicant: Barry E Pryor, Laurel, MS (US)

(72) Inventor: Barry E Pryor, Laurel, MS (US)

( * ) Notice: Subject to any disclaimer, the term of this patent is extended or adjusted under 35 U.S.C. 154(b) by 477 days.

(21) Appl. No.: 14/062,336

(22) Filed: Oct. 24, 2013

Related U.S. Application Data

(60) Provisional application No. 61/727,434, filed on Nov. 16, 2012.

(51) Int. Cl.
*E21B 43/12* (2006.01)

(52) U.S. Cl.
CPC ..... *E21B 43/124* (2013.01)

(58) Field of Classification Search
CPC ..... E21B 43/124
See application file for complete search history.

(56) References Cited

U.S. PATENT DOCUMENTS 4,415,038 A 11/1983 Schmuck
4,448,427 A 5/1984 Mashaw, Jr.
4,560,005 A 12/1985 Helderle et al.
5,372,190 A * 12/1994 Coleman ..... F04F 5/10 166/105
9,297,239 B2 * 3/2016 Lopez Robayo ..... E21B 43/124
2005/0155767 A1 * 7/2005 Batho ..... E21B 34/10 166/370
2007/0119594 A1 5/2007 Turner et al.
2007/0144744 A1 6/2007 Wong
2008/0115934 A1 * 5/2008 Pettinato ..... E21B 43/124 166/254.1
2011/0259595 A1 10/2011 Nguy et al.
2014/0234127 A1 * 8/2014 Burgess ..... F04F 5/54 417/151

* cited by examiner

*Primary Examiner* — William P Neuder
(74) *Attorney, Agent, or Firm* — George L Williamson

(57) ABSTRACT

Method and apparatus for a hydraulic jet pump housing system for selective positioning of a slidable, ported inner sleeve using wireline shifting tools in a downhole condition which allows flow between the annulus and tubing string through the ported outer sleeve housing and ported inner sleeve when in the open position. When the ported inner sleeve is in the closed position, the annulus and tubing string are isolated from each other. The open position permits normal functioning of a hydraulic jet pump when seated in a standing valve in the same manner as a conventional hydraulic jet pump cavity assembly. The hydraulic jet pump can be extracted and inner sleeve shifted closed without using a blanking tool so that annular fluids are prevented from flowing into the production formation through the tubing string when the standing valve is removed.

24 Claims, 5 Drawing Sheets

JET PUMP SYSTEM FOR WELL

RELATION TO PREVIOUS APPLICATIONS

This application claims benefit of United States Provisional Patent Application having Ser. No. 61/727,434 filed on Nov. 16, 2012.

BACKGROUND OF THE INVENTION

1. Field of the Invention

The present invention relates generally to valves and, more particularly, is concerned with housings for valves of the type having side doors being useful with hydraulic jet pumps used in the oil and gas industry.

2. Description of the Related Art

Cavities/housings for containing valve assemblies for use with jet pump systems have been described in the related art, however, none of the related art devices disclose the unique features of the present invention.

The conventional hydraulic jet pump system, including the cavity/housing and hydraulic jet pump, have and still do address unique types of obstacles in specific types of well conditions where artificial lift is desired. That uniqueness occurs when three common factors become apparent, but not limited to those factors only, as follows: (1) they are too deep for rod pumping; (2) they have high concentrations of hydrogen sulfide present; and, (3) their bottom hole pressure depletes to the point that they cannot support any column of fluid. The related art for this assortment of production obstacles was the introduction and use of hydraulic jet pumps and cavities/housings and related surface accessories. Production flow results from fluid (power fluid, e.g., oil) being pumped down the tubing and through the hydraulic jet pump (seated in a standing valve above a packer) where a Ventura effect causes a siphoning of production fluid into the pump which then flows into the annulus and back to surface storage. The hydraulic jet pump cavity/housing houses the hydraulic jet pump on-seat while this action occurs. The conventional hydraulic jet pump cavity/housing has ports that allow for the production fluid flowing out of the hydraulic jet pump to flow into and up the annulus. If there is no hydraulic jet pump or blanking tool in place in the hydraulic jet pump cavity, the annulus and tubing string are completely flow communicated. The blanking tool serves as an insertion device in the cavity to prevent flow between the annulus and tubing string. The blanking tool cannot be inserted until the standing valve is removed, which opens an unrestricted flow path to the production formation prior to the blanking tool being inserted and sealed. The blanking tool only holds pressure from inside (with limited pressure from the outside) and has an extremely restricted inside diameter. These three factors result in the blanking tool not being dependable and having low utility where downhole operations, controls and treatments are concerned.

In U.S. Pat. No. 4,448,427 dated May 15, 1984, Mashaw, Jr. disclosed a piston expanded metallic seal for side door weld valve. In U.S. Patent Application Publication No. 2007/0144744 dated Jun. 28, 2007, Wong disclosed a valve apparatus with seal assembly. In U.S. Pat. No. 4,560,005 dated Dec. 24, 1985, Helderle, et al., disclosed a sliding sleeve valve for an oil well. In U.S. Patent Application Publication No. 2011/0259595 dated Oct. 27, 2011, Nguy, et al., disclosed a mechanical sliding sleeve. In U.S. Patent Application Publication No. 2007/0119594 dated May 31, 2007, Turner, et al., disclosed a hydraulic sleeve valve with position indication, alignment and bypass. In U.S. Pat. No. 4,415,038 dated Nov. 15, 1983, Schmuck disclosed a formation protection valve apparatus and method.

While these valves for use with hydraulic jet pump systems may be suitable for the purposes for which they were designed, they would not be as suitable for the purposes of the present invention as hereinafter described.

SUMMARY OF THE PRESENT INVENTION

The present invention discloses a hydraulic jet pump housing or cavity that provides greater utility in a downhole condition. The present invention allows for opening and closing of ports by means of wireline shifting tools where the annulus and tubing string are flow communicated or the annulus and tubing string are flow isolated from each other. Also, the apparatus incorporates a slidable inner ported sleeve encased by a ported outer housing. The apparatus also incorporates a standing valve seat in the lower section of the cavity to allow for the placement of a standing valve within the apparatus. Dimensionally, this apparatus internally has the same sealing points and similar flow paths as a conventional hydraulic jet pump cavity/housing which allows any well owner to use the same style and size hydraulic jet pumps that are presently used on existing wells that are on hydraulic jet pump systems. The only required adjustment normally will be to replace the existing jet nozzle adapter sub with an extended (lengthened) version, i.e., a nozzle extension, for proper spacing of the hydraulic jet pump within the hydraulic jet pump cavity/housing. Note that due to the apparatus having the same sealing points, a pressure balanced isolation tool can be inserted to isolate the annulus from the tubing string should there be reasons the apparatus could not be closed or utilize the valve as a means for fresh water or chemical injection from the annulus into the produced fluids.

An object of the present invention is to minimize costs for well operators converting from convention hydraulic pump cavities to the present invention where they gain considerable utility over conventional hydraulic jet pump cavities.

Another object of the present invention is the ability to select the option of an open flow path between the annulus and tubing string or a closed flow path between the annulus and tubing string due to selectively positioning to an open or closed position by manipulation of the slideable ported inner sleeve. Better control of well fluids flow is achieved by these open or closed position options. One aspect of the present invention allows for the placing of this apparatus in the initial well completion in the closed position, with its full opening inside diameter. Subsequently, when the well ceases to flow, it can easily be converted to a hydraulic jet pump system. Also, prior to inserting a standing valve and a hydraulic jet pump, the well can have downhole operations performed such as, but not limited to, the following: slickline operations, electric line operations, coil tubing operations, TCP perforating, treatments, stimulations and dependable swabbing performed in a closed and controlled system.

Another object of the present invention is to control fluid loss to the subterranean low pressure production formation when a standing valve is removed. Eventually, hydraulic jet pumps and standing valves are removed from downhole assemblies and with the option of closing and isolating the annulus from the tubing string the loss of annular fluid into production formation is stopped when is standing valve is pulled, i.e., removed, which opens a flow path to the subterranean low pressure production formation.

Advantages of the present invention include that it provides a valve assembly for use with a hydraulic jet pump cavity/housing which allows for selective positioning of a slideable, ported inner sleeve using wireline shifting tools in a downhole condition. The selective positioning allows flow communication from and to the annulus and tubing string through the ported outer sleeve housing and ported inner sleeve when in the open position. When the ported inner sleeve is in the closed position, the annulus and tubing string are isolated from each other. The open position permits normal functioning of a hydraulic jet pump when seated in a standing valve as power fluid is pumped down the tubing causing a ventura effect on the production fluids from low pressure subterranean production formation in the same manner as a conventional hydraulic jet pump cavity assembly. When the hydraulic jet pump is extracted and inner sleeve is shifted to closed position, eliminating the use of a blanking tool as required by the related art, annular fluids are prevented from flowing into the production formation through the tubing string when the standing valve is removed. Also, a large inner diameter is available through the standing valve seat, where a variety of operations can be performed while the tubing string is isolated from the annulus. This hydraulic jet pump cavity allows its inclusion in an initial completion where low pressure subterranean production formations are expected after initial production flow. It can be incorporated into the initial completion equipment in the closed position without restricting the tubing access to the production formation for future operations which may include putting the well on a hydraulic jet pump system. Also, the present invention eliminates the need of a blanking tool to provide tubing to casing annulus isolation. Also, the present invention eliminates the need to re-complete the well by including the pump cavity in the well bore during initial completion which also saves money by eliminating lost production time or lost days of production and eliminates the rig cost for re-completing the well.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
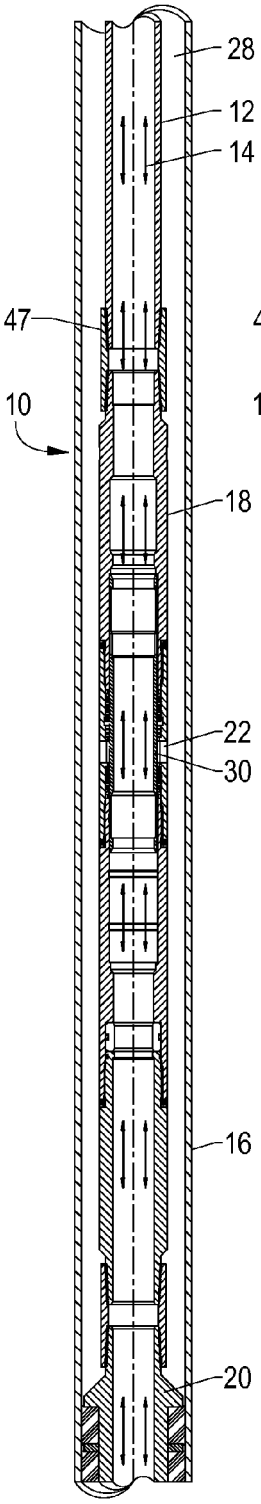
FIG. 1 is a longitudinal full section view of the system including a sliding sleeve valve in the closed position just above the packoff device according to the present invention.

With regard to reference numerals used, the following numbering is used throughout the drawings.

10 present invention
12 tubing conduit
14 arrow
15 arrow
16 well conduit
18 valve assembly
20 packer
22 ports
24 standing valve
25 ball
26 standing valve seat insert
28 annulus
30 inner valve sleeve
34 outer valve sleeve
36 modified shifting tool
38 hydraulic jet pump
39 discharge apertures
40 nozzle extension
41 seal
42 tapered seat
44 top sub
46 threaded connection
47 coupling
48 threads
50 middle sub
52 set screw
54 upper seal
56 sealing member end adapter
58 seal backup
60 spring energized seal
62 spring energizer
64 diffuser end adapter
66 O-ring
70 split ring retainer
72 lower middle sub thread
74 lower sub
76 set screw
78 lower seal
80 O-ring

82 teflon backup ring
84 bottom sub
88 O-ring
90 teflon backup ring
92 threaded sealing tubing connection
94 upper packing bore
96 lower packing bore
98 threads
100 port
102 upper end
104 lower end
106 top sub
108 set screw
110 spacer
112 upper key retainer
114 spring
116 keys
118 lower key retainer
120 collet
122 body
124 type "B" shifting tool
126 set screw
128 top sub
130 shear pin x
132 key retainer (top)
134 collet
136 spring x
138 keys
140 key retainer (bottom)
142 body
144 seal assembly
146 seal assembly
148 seal assembly
150 polished pack-off area
152 polished pack-off area
154 wireline tool string

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 16 illustrate the present invention wherein a housing for a valve assembly for use with a hydraulic jet pump is disclosed and which is generally indicated by reference number 10.

The present invention 10 discloses a well downhole hydraulic jet pump cavity or housing system incorporating a sliding sleeve valve assembly for flow control. The present invention 10 differs, at a minimum, from conventional flow control sliding valves in that it discloses aligned and enlarged flow ports, a standing valve seat, non-elastomeric seals or packing gland areas to accommodate conventional hydraulic jet pumps, and other associated elements which will be disclosed in the description which follows.

The system of the present invention 10 can be assembled for use in a string of tubing conduit to form a part of that string as a method of retrieving well fluids from the desired producing formation of the subterranean formations of the well. This is a specialized method used in a string of production tubing primarily, but not limited to, production tubing use, but it is expected that it could also be used on other conduits used in the well.

For purposes of this specification, and unless otherwise noted, the terms "longitudinal" and "transverse" will be used with reference to the system as a whole, "length" of the system or a part thereof will be with reference to the longitudinal direction of the system as a whole; "depth" will be with reference to a longitudinal direction with respect to the system as a whole; and "width" will be with reference to a transverse or circumferential direction with respect to the system as a whole.

Also, throughout this specification, the process of shifting parts or elements of the present invention 10 referenced herein is accomplished with the use of a wireline shifting tool 36, which is specially made, or 124 (best shown in FIGS. 10 and 11) as would be done in the standard manner by one skilled in the art.

Turning to FIG. 1, therein is shown the system configured for two-way inward and outward flow as indicated by arrow 14 in the tubing conduit 12. This configuration has no standing valve in the system. The tubing conduit 12 is shown internal the well conduit 16 along with valve assembly 18 which is connected to the packoff sealing device 20 at its lower end, i.e., the packer, that is run into the well conduit 16 from the surface to a desired setting depth and the packoff device 20 is activated and set in place to create a seal with the well conduit 16. Note that the ports 22 are closed by the inner valve sleeve 30 being shifted upwardly longitudinally. Also shown is annulus 28 between the tubing conduit 12 and well conduit 16. Also shown is coupling 47.

Figure 2:
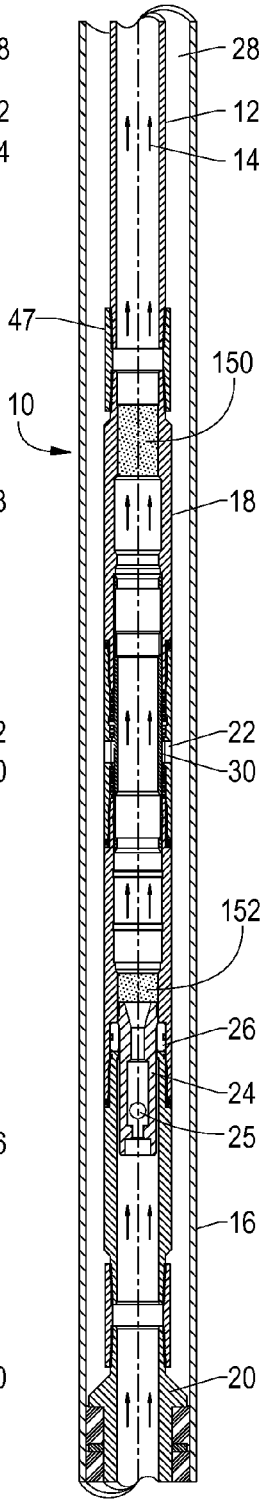
FIG. 2 is a view similar to that of FIG. 1 with a standing valve installed and sliding sleeve valve in the closed position with limited flow of well fluids.

Turning to FIG. 2, therein is shown the system configured for only outward flow in the tubing conduit 12 as shown by arrow 14 with a conventional standing valve 24 being installed similar to that used in the related art which is a type of check valve disposed in position against the standing valve seat 26 so that the standing valve allows only outward flow as shown by ball 25 being off its seat. Note that the ports 22 are closed by the inner valve sleeve 30 being shifted upwardly longitudinally. Also shown by stippling are polished pack-off areas 150, 152 on the inner surface of valve assembly 18 wherein pack-off area 150 receives the seal 41 from the hydraulic jet pump 38 (see FIG. 4) and pack-off area 152 can receive and accommodate other flow control devices which are widely used in the oil and gas industry. While all FIGS. 1-4 include the polished pack-off areas 150, 152, only FIG. 2 illustrates the stippling.

Figure 3:
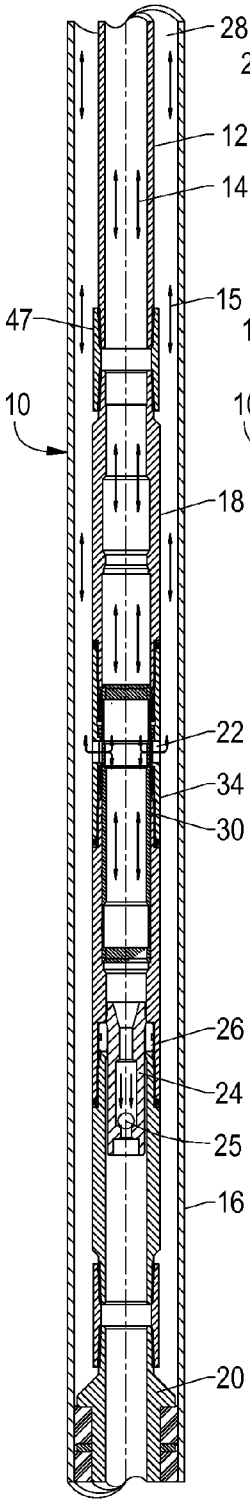
FIG. 3 is a view similar to that of FIG. 2 with the sliding sleeve valve in the open position showing limited flow of well fluids.

Turning to FIG. 3, therein is shown the system configured for the circulating mode for two way flow in both the tubing conduit 12 and the annulus 28 as shown by arrows 14 and 15 wherein the inner valve sleeve 30 is shifted in the downward longitudinal direction to allow the ports 22 in the inner valve sleeve 30 to align with the ports 22 in the outer valve sleeve 34 (note that sleeve 34 is referred to as the middle sub 50 in FIG. 7) to allow fluid communication between the bore of the inner tubing conduit 12 and annulus 28. The standing valve 24 is closed as shown by ball 25 being seated.

Figure 4:
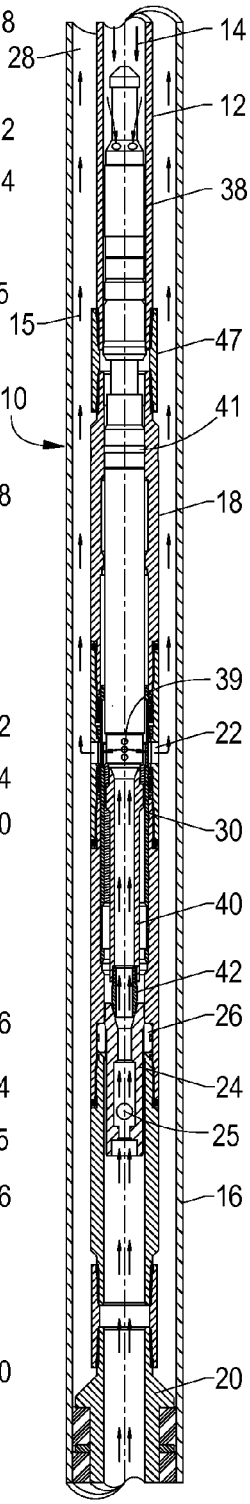
FIG. 4 is a view similar to that of FIG. 3 with the hydraulic jet pump in place redirecting well fluids to the surface with the hydraulic pressure from the surface.

Turning to FIG. 4, therein is shown the system configured in the production mode with outward flow in the annulus 28 as shown by arrow 15 and inward flow in the tubing conduct 12 as shown by arrows 14 and 15 having the ports 22 open. Also shown is a conventional hydraulic jet pump 38 and a nozzle extension 40. The conventional hydraulic jet pump 38 of the related art is fitted with a unique nozzle extension 40 (see detailed view FIG. 6) and pumped down or run in with wireline or like device and landed with the tapered seat 42 on its nose contacting the outlet of the standing valve 24 which is open as shown by ball 25 being off its seat. In this configuration (as best seen in enlarged FIG. 5) the ports 22 in the sliding sleeve valve 18 and the hydraulic jet pump 38 and its multiple discharge apertures 39 are in line relative to longitudinal length, depth and width with each other due to the use of the nozzle extension 40. Also, the inner valve sleeve 30 is shifted downwardly. The hydraulic jet pump 38 is held in place hydrostatically from tubing pressure above the pump.

Figure 6:
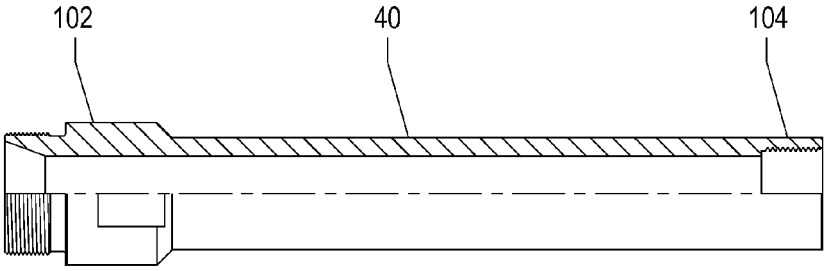
FIG. 6 is the hydraulic jet pump nozzle extension required to line up with the ports of the sliding sleeve valve.
Figure 5:
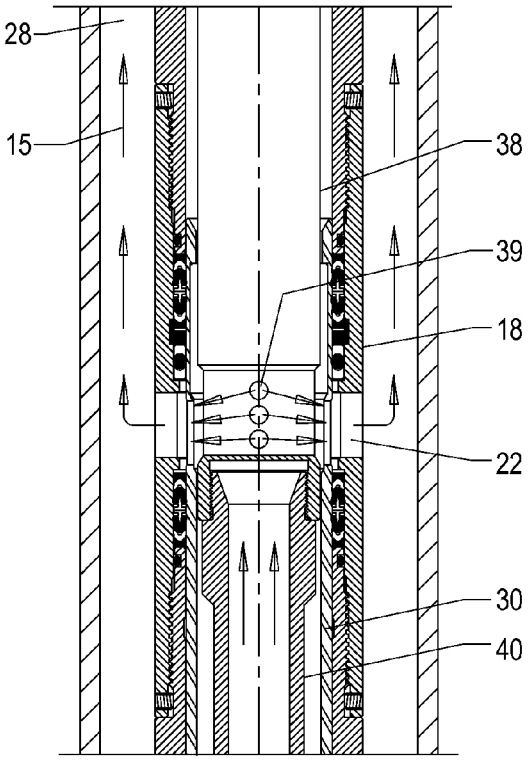
FIG. 5 is an enlarged view of the hydraulic jet pump ports lined up with the ports of the sliding sleeve valve.

Turning to FIG. 6, therein is shown the previously disclosed nozzle extension 40 having upper 102 and lower 104 ends. The unique nozzle extension 40 was developed to space the hydraulic jet pump 38 away from the standing valve 24 so that its (the hydraulic jet pump) side ports 22 align with the port created by shifting the inner valve sleeve down and tubing conduit ports for transferring production fluid from the jet pump into the annulus for flow upwardly for surface storage as best shown in FIG. 5.

Figure 7:
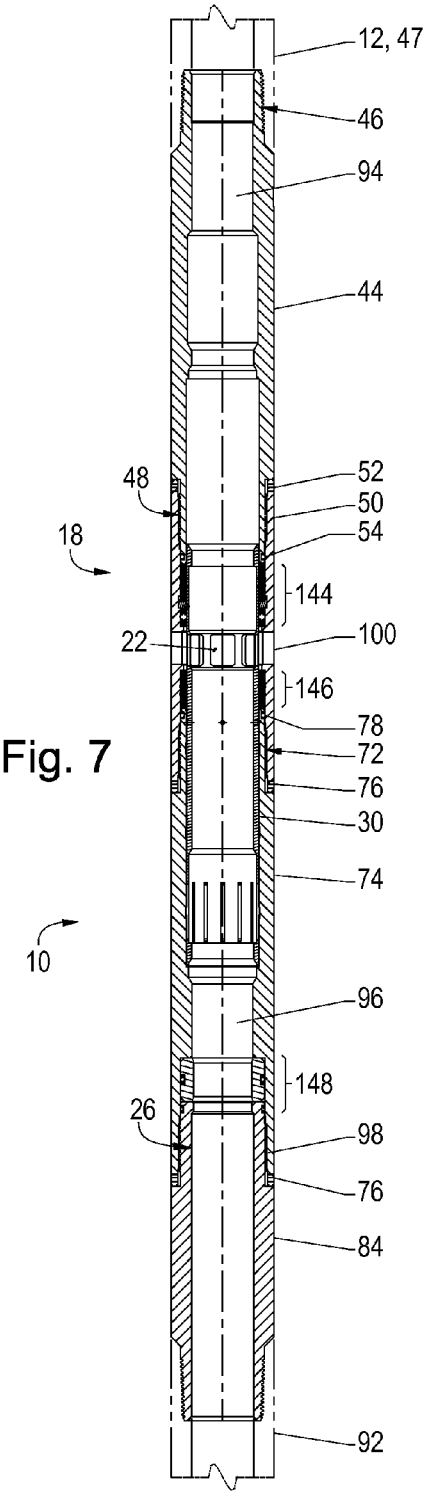
FIG. 7 is a longitudinal full section view of a sliding sleeve valve in the open position.

Turning to FIG. 7, therein is shown the present invention 10 including the valve assembly 18 having a top sub 44 which connects to the lower end of tubing conduit 12 by means of a threaded tubing conduit connection area 46 for receiving mating coupling 47. The lower end of top sub 44 is threaded at 48 to the middle sub 50 which serves as a seal housing and locked in place with set screws 52 and upper seal 54. The middle sub or seal housing 50 (note that middle sub 50 is referred to as the outer valve sleeve 34 in FIG. 3) includes the non-elastomeric sealing assembly members 144, 146, above and below ports 22, respectively, as shown in the enlargement in FIG. 8 and includes the sealing member end adapter 56, seal backup 58, spring energized seal 60, and spring assisted energizer 62 which make up the upper and lower sealing members of the sliding valve sleeve 18; also, the diffuser end adapter 64 and O-ring 66 make up the equalizing bypass seal for the sliding valve sleeve 18; the diffuser seal adapter or device 64 is held in place with the split ring retainer 70. These together provide sealing means for the inner sliding valve sleeve 30. The non-elastomeric sealing assembly members 144, 146 provide better seals to prevent leaking and also make sliding/shifting easier because they resist sticking to the inner surface of the valve assembly 18. Continuing with FIG. 7, the lower end of the middle sub or seal housing 50 is threaded at 72 and is connected to the lower sub/insert housing 74 of the sliding valve assembly 18 and locked in place with upper and lower set screws 76. The lower sub/insert housing 74 seals to the middle sub/seal housing 50 with lower seal 78. Bottom sub 84 is threaded onto lower sub 74 and locked in place with set screws 76. Note that each of the upper and lower seals 54 and 78 of FIG. 7 are the same as elements 90, 88, 90 taken together as shown in FIG. 9. Also shown is seal assembly 148 also shown in the enlargement in FIG. 9. Also shown are upper packing bore 94, lower packing bore 96, threads 98 and port 100 in middle sub 50.

Figure 8:
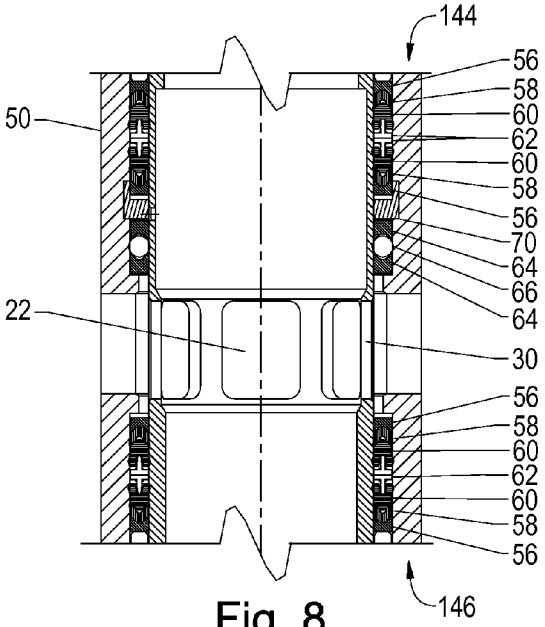
FIG. 8 is an enlarged view showing additional details of FIG. 7.
Figure 9:
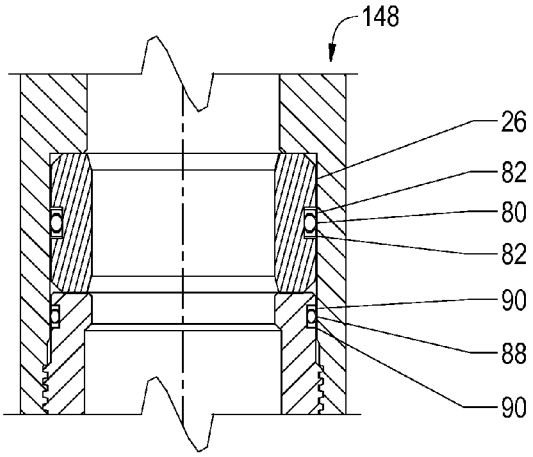
FIG. 9 is an enlarged view showing additional details of FIG. 7.

Turning to enlarged view FIG. 8, therein is shown the non-elastomeric seal assembly 144 and 146 disclosing the sealing member end adapter 56, seal backup 58, spring energized seal 60, and spring assisted energizer 62 which make up the upper and lower sealing members of the sliding valve sleeve 18. Also, the diffuser end adapter 64 and O-ring 66 make up the equalizing bypass seal for the sliding valve sleeve 18. The diffuser seal adapter or device 64 is held in place with the split ring retainer 70. These seal assemblies 144 and 146 together provide sealing means for the inner sliding valve sleeve 30. Also shown is middle sub 50, inner valve sleeve 30 and ports 22.

Turning to enlarged view FIG. 9, therein is shown the seal assembly 148 disclosing the standing valve seat insert 26 which includes O-ring 80 and its two teflon backup rings 82 to provide a seal with the inside diameter of the lower sub 74 when installed. Bottom sub 84 seals against lower sub 74 using O-ring 88 and its two backup rings 90. Bottom sub 84 is connected to the packoff device 20 (not shown, see FIGS. 1-4) with a threaded sealing tubing connection 92.

Figure 10:
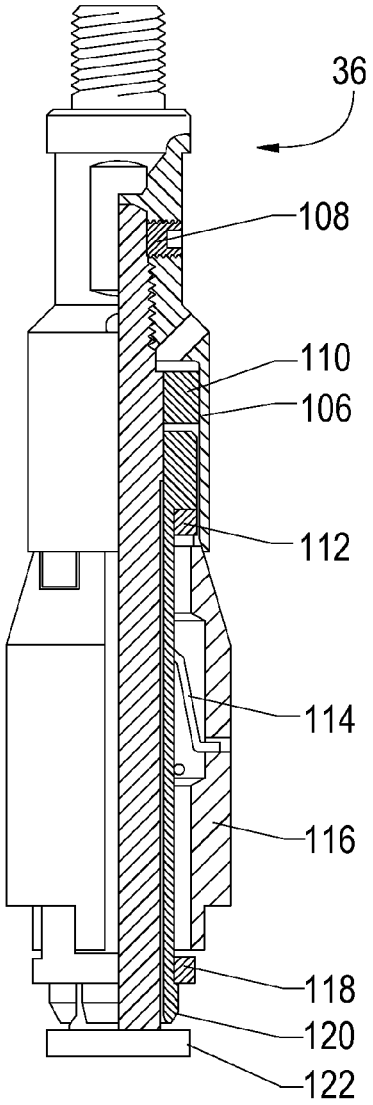
FIG. 10 is a half section view of a modified shifting tool which may be used with certain operations related to the present invention.

Turning to FIG. 10, shown therein is the special modified shortened shifting tool 36 used for opening the valve assembly 18 with standing valve 24 in place including the top sub 106, set screw 108, spacer 110, upper key retainer 112, spring 114, keys 116, lower key retainer 118, collet 120 and body 122. The shifting tool 36 is designed according to the teachings of the present invention to selectively locate and shift most sliding side door sleeves or valve assemblies 18. This is accomplished by the shifting tool's 36 keys 116 engaging the valve assembly 18 inner sleeve 30 wherein the sleeve is shifted down to open the valve. The keys 116 have been modified to allow the shortened shifting tool 36 to shift the sleeve of the valve assembly 18 open with the standing valve 24 in place.

The method of using a conventional hydraulic jet pump 38 is different according to the teachings of the present invention 10 because a shortened extension 40 (as shown in FIG. 6) has been developed to provide the proper alignment between the pump 38 and the sliding sleeve ports 22 when the pump 38 is run in and seated in the standing valve seat 24 (as shown in FIG. 4). Ports 22 are also enlarged according to the teachings of the present invention 10. Having the ports 22 aligned and enlarged reduces well fluid turbulence and pressure loss from production fluids when in the production mode (as shown in FIG. 4).

Figure 11:
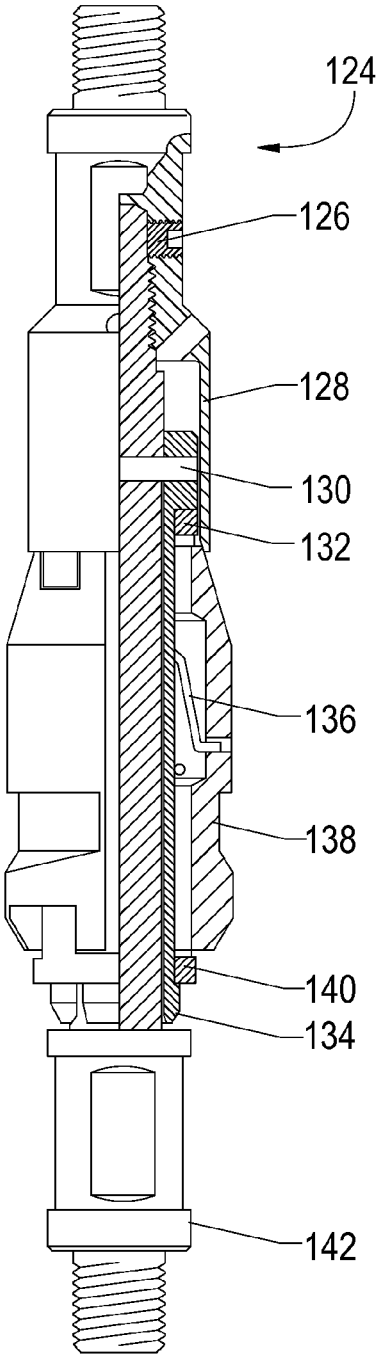
FIG. 11 is a half section view of a type "B" shifting tool which may be used with certain operations related to the present invention.

Turning to FIG. 11, shown therein is a conventional Type-B self releasing shifting or positioning tool 124 which may be used to open the valve assembly 18 and is always used to close the valve, and, it can only be used to open the valve when the standing valve 24 is not in place. Shown are the set screw 126, top sub 128, shear pin 130, top key retainer 132, collet 134, spring 136, keys 138, bottom key retainer 140 and body 142.

Figure 12:
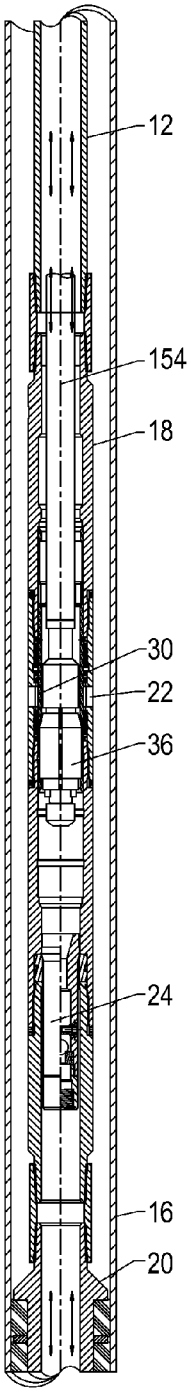
FIGS. 12-15 are longitudinal full section views of the system illustrating how a shifting tool is used to open or close the sliding sleeve valve of the present invention.
Figure 13:
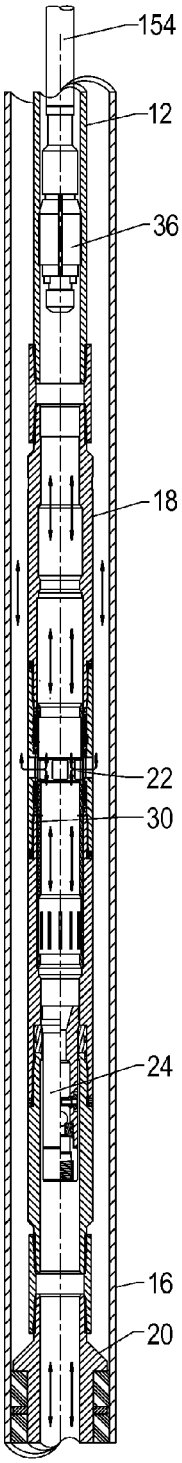
Figure 14:
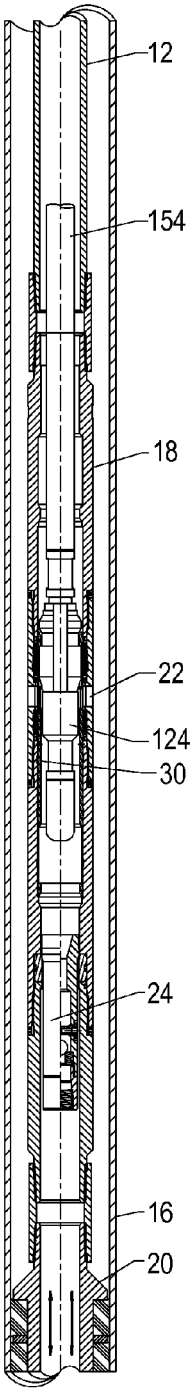
Figure 15:
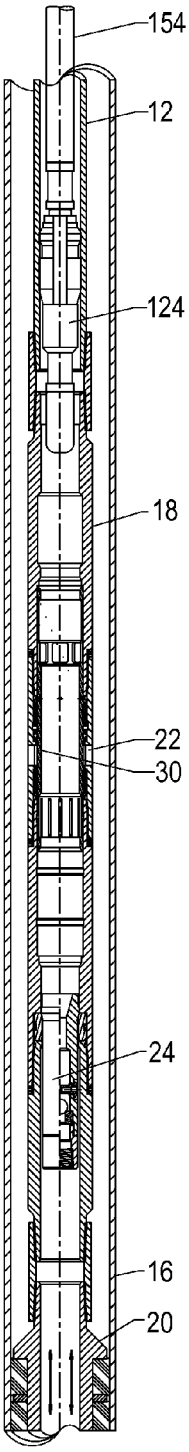

Turning to FIGS. 12 to 15, shown therein are examples of using a shifting tool 36 or 124 to shift the inner sleeve 30 of valve assembly 18. FIG. 12 shows the shifting tool 36 in place to shift the valve 18 to open from closed; FIG. 13 shows the valve 18 shifted open and shifting tool 36 being removed; FIG. 14 shows the shifting tool 124 in place to shift the valve 18 closed from open; and, FIG. 15 shows the valve 18 shifted closed and shifting tool 124 being removed. Also shown is a wireline tool string 154 being used to run in the shifting tool 36 or 124. Other previously disclosed elements are also shown.

Figure 16:
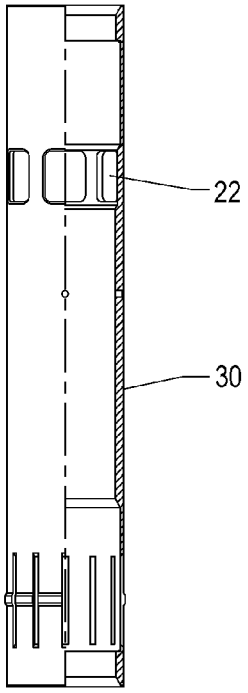
FIG. 16 is a half section view of an inner valve sleeve.

Turning to FIG. 16, shown therein is the inner valve sleeve 30 along with the effectively enlarged and substantially square shaped ports 22 which enhance fluid flow by reducing fluid turbulence. The ports 22 are effectively sized so as to maximize the total area dedicated to the ports which would be attainable from the maximum surface area available from a given diameter of sleeve.

A short concise summary making reference to all the drawings follows wherein the present invention 10 discloses a substantially full-opening device with an inner sleeve (valve) 18 that can be opened or closed using conventional wireline methods to provide fluid communication between the tubing 12 and tubing/casing annulus 28. The present invention 10 features internal polished pack-off areas above, shown at 150, and below, shown at 152, the inner sliding sleeve (valve) 18 as an integral part of the housing assembly. This provides a location for the seals of, but not limited to, the hydraulic jet pump 38 and isolation tool (not shown) for a fail close mechanism in the event of well conditions preventing the inner sleeve (valve) 18 from being shifted to the closed position or failure of the internal seal components of the device to provide isolation of the tubing 12 to tubing/casing annulus 28. The present invention 10 also features a standing valve seat insert 26 below the internal polished pack-off area 152 to provide a seating area for the standing valve 24 normally associated with the use of a hydraulic jet pump 38, and other related uses of a standing valve, such as, but not limited to, testing the integrity of the tubing conduit 12 and its associated components and the circulation of fluids between the tubing 12 and casing conduit 28 thru the circulation ports 22 of the cavity while preventing the loss of the fluid to open subterranean formations of the well below the packer 20.

I claim:

1. A hydraulic jet pump housing system incorporating a sliding sleeve assembly for use in a well downhole, comprising:

a) a well conduit disposed in the well;

b) a tubing conduit within said well conduit forming an annulus between said well and tubing conduits;

c) a valve assembly disposed in said tubing conduit, said valve assembly having side ports, said valve assembly having a cavity therein, said cavity for adding a hydraulic jet pump system when the well ceases to flow naturally;

d) a slidable inner valve sleeve having side ports disposed inside said valve assembly;

e) a packoff sealing device connecting said tubing conduit to said well conduit below said valve assembly for sealing said annulus at a lower end thereof;

f) a standing valve disposed in said tubing conduit below said inner valve sleeve for allowing only outward flow through said standing valve;

g) said inner valve sleeve having an upward position in which said side ports are out of alignment with said valve assembly side ports thereby preventing flow between said annulus and said tubing conduit whereby only outward flow in said tubing conduit is allowed;

h) said inner valve sleeve having a downward position in which said side ports align with said valve assembly side ports thereby allowing flow of fluids between said annulus and said tubing conduit, whereby two way flow is allowed in said tubing conduit above said standing valve and two way flow is allowed in said annulus above said packoff sealing device; and, i) means for moving said inner valve sleeve between said upward and downward positions thereby allowing for better control of fluids flow in the well.

2. The hydraulic jet pump housing system of claim 1, further comprising:

a) a hydraulic jet pump disposed in said cavity using power fluid for siphoning production fluids originating from low pressure subterranean production formations and out of said standing valve;

b) said jet pump having a tapered seat at an outlet of said standing valve; and, c) said jet pump having side ports alignable with said inner valve sleeve ports and tubing conduit ports for transferring production fluid from said jet pump into said annulus for flow upwardly for surface storage.

3. The hydraulic jet pump housing system of claim 2, wherein said jet pump has a downwardly extending nozzle extension for proper spacing of said jet pump above said standing valve.

4. The hydraulic jet pump housing system of claim 3, wherein said tapered seat is disposed between a lower end of said nozzle extension and said outlet of said standing valve.

5. The hydraulic jet pump housing system of claim 4, further comprising means for sealing said inner valve sleeve.

6. The hydraulic jet pump housing system of claim 5, wherein said means for sealing further comprises a first non-elastomeric seal assembly disposed above said side ports of said valve assembly and a second non-elastomeric seal assembly disposed below said side ports of said valve assembly.

7. The hydraulic jet pump housing system of claim 6, further comprising a spring assisted energizer disposed in said first and second non-elastomeric seal assembly.

8. The hydraulic jet pump housing system of claim 5, wherein a shifting tool is used for opening said valve assembly with said standing valve in place.

9. The hydraulic jet pump housing system of claim 8, wherein said shifting tool uses keys to engage said valve assembly.

10. The hydraulic jet pump housing system of claim 9, further comprising a first polished pack-off area disposed above said inner valve sleeve and a second polished pack-off are disposed between said inner valve sleeve and said standing valve.

11. A method for a hydraulic jet pump housing incorporating a sliding sleeve assembly for use in a well downhole, comprising the steps of:

a) providing a well conduit in the well;

b) providing a tubing conduit in the well conduit forming an annulus between the well and tubing conduits;

c) providing a valve assembly in the tubing conduit, the valve assembly having side ports and a cavity therein, the cavity for adding a hydraulic jet pump when the well ceases to flow naturally;

d) providing a slidable inner valve sleeve having side ports inside the valve assembly;

e) providing a packoff sealing device connecting the tubing conduit in the well conduit below the valve assembly for sealing the annulus at a lower end thereof;

f) providing a standing valve in the tubing conduit below the inner valve sleeve for allowing only outward flow through the standing valve;

g) the inner valve sleeve having an upward position in which the side ports are out of alignment with the valve assembly side ports thereby preventing flow between the annulus and the tubing conduit whereby only outward flow in the tubing conduit is allowed;

h) the inner valve sleeve having a downward position in which the side ports align with the valve assembly side ports thereby allowing flow of fluids between the annulus and the tubing conduit, whereby two way flow is allowed in the tubing conduit above the standing valve and two way flow is allowed in the annulus above the packoff sealing device; and i) moving the inner valve sleeve between the upward and downward positions thereby allowing for better control of fluids flow in the well.

12. The method of claim 11, further comprising the steps of:

a) providing a hydraulic jet pump in the cavity using power fluid for siphoning production fluids originating from low pressure subterranean production formations and out of the standing valve;

b) wherein the jet pump has a tapered seat at an outlet of the standing valve; and, c) wherein the jet pump has side ports alignable with the inner valve sleeve ports and the valve assembly ports for transferring production fluid from the jet pump into the annulus for flow upwardly for surface storage.

13. The method of claim 12, wherein the jet pump has a downwardly extending nozzle extension for proper spacing of the jet pump above the standing valve.

14. The method of claim 13, wherein the tapered seat is disposed between a lower end of the nozzle extension and the outlet of the standing valve.

15. The method of claim 14, further comprising the step of sealing the inner valve sleeve.

16. The method of claim 15, further comprising the step of providing a first non-elastomeric seal assembly above the side ports of the valve assembly and a second non-elastomeric seal assembly below the side ports of the valve assembly.

17. The method of claim 16, further comprising the step of providing a spring assisted energizer in the first and second non-elastomeric seal assembly.

18. The method of claim 15, further comprising the steps for using a shifting tool for opening the valve assembly with the standing valve in place.

19. The method of claim 18, wherein the shifting tool uses keys to engage the valve assembly.

20. The method of claim 19, further comprising the step of providing a first polished pack-off area above the inner valve sleeve and a second polished pack-off area between the inner valve sleeve and the standing valve.

21. The method of claim 20, further comprising the step of shaping the inner valve sleeve side ports to be substantially square shaped to enhance fluid flow.

22. The method of claim 21, further comprising the step of adapting the inner valve sleeve to be used with a hydraulic jet pump.

23. The method of claim 22, further comprising the step of inserting and removing the hydraulic jet pump by using a pump without using a wireline tool string.

24. The method of claim 23, further comprising the step of opening and closing the side ports of the valve assembly by using a wireline tool string.

* * * * *